US006241455B1

(12) United States Patent
Schupback et al.

(10) Patent No.: US 6,241,455 B1
(45) Date of Patent: Jun. 5, 2001

(54) EARTH-MOVING MACHINE BUCKET COUPLER

(75) Inventors: Jesse Larry Schupback; Craig A. Callewaert, both of Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/386,811

(22) Filed: Aug. 31, 1999

(51) Int. Cl.[7] ..... E02F 3/32; E02F 3/40
(52) U.S. Cl. ..... 414/723; 37/468; 172/272
(58) Field of Search ..... 414/680, 685, 414/687, 688, 694, 722, 723; 37/403, 443, 468, 903; 403/15; 172/272

(56) References Cited

U.S. PATENT DOCUMENTS

| | | | | |
|---|---|---|---|---|
| 4,890,974 | * | 1/1990 | Kistner | 414/723 |
| 5,242,258 | | 9/1993 | Weyer . | |
| 5,333,400 | | 8/1994 | Sonerud . | |
| 5,431,528 | * | 7/1995 | Jenkins et al. | 414/723 |
| 5,456,030 | | 10/1995 | Barone et al. . | |
| 5,465,513 | | 11/1995 | Sonerud . | |
| 5,484,250 | | 1/1996 | Gilmore, Jr. et al. . | |
| 5,546,683 | | 8/1996 | Clark . | |
| 5,692,852 | * | 12/1997 | Collins | 414/723 X |
| 5,727,342 | | 3/1998 | Horton . | |
| 5,732,488 | | 3/1998 | Smith . | |
| 5,802,753 | * | 9/1998 | Raunisto | 37/468 |
| 6,042,295 | * | 3/2000 | Barden | 414/723 X |
| 6,058,633 | * | 5/2000 | Barden | 37/468 |
| 6,108,951 | * | 8/2000 | Renfrow et al. | 414/723 X |

OTHER PUBLICATIONS

Case—Loader/Backhoe 580L; 1996 Case Corporation (19 pgs.).

* cited by examiner

*Primary Examiner*—Robert P. Olszewski
*Assistant Examiner*—Gerald J. O'Connor
(74) *Attorney, Agent, or Firm*—Foley & Lardner

(57) ABSTRACT

An earth-moving machine includes a coupling releasably joining a bucket to an end of a dipper stick. The coupling includes a hook pivotably coupled to the dipper stick about a first axis and configured to engage a pin secured to the bucket. The coupling further includes a pair of pins coaxially disposed along the axis and movable between an extended position in which the pins are received within a pair of spaced openings on the bucket to join the bucket to the dipper stick and a retracted position in which the pins are removed from the openings. The pins are actuated between the extended position and the retracted position by an actuator disposed along the axis between the pins. The actuator preferably includes a cylinder, first and second pistons disposed within the cylinder and coupled to the first and second pins, respectively, and at least one source of hydraulic pressure fluidly coupled to the cylinder to pressurize the cylinder and to move the first and second pistons and the first and second pins. The cylinder is preferably disposed within a bushing coupled to the dipper stick.

19 Claims, 6 Drawing Sheets

FIG. 4
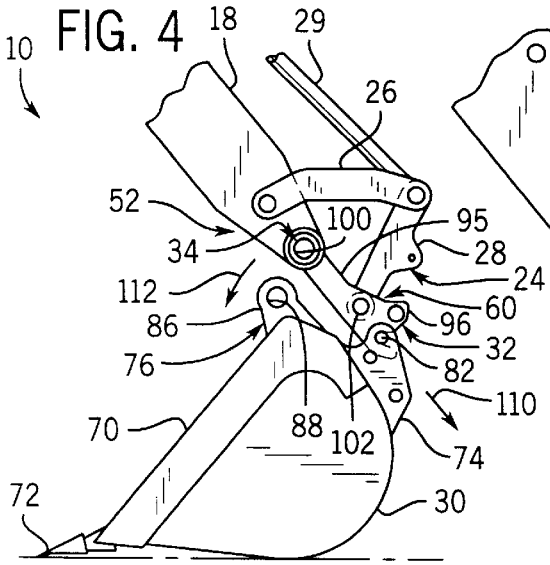
FIG. 2
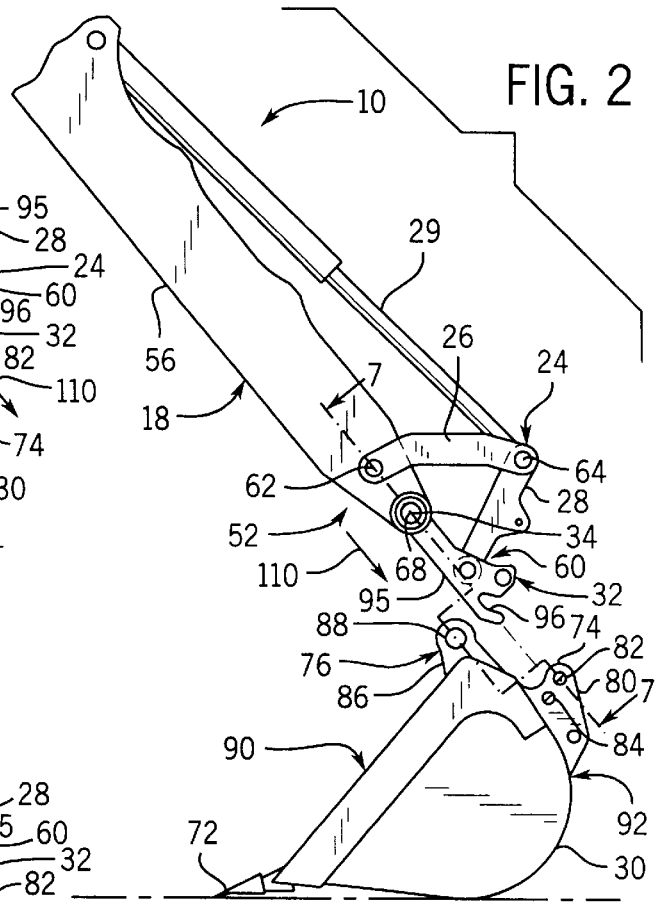
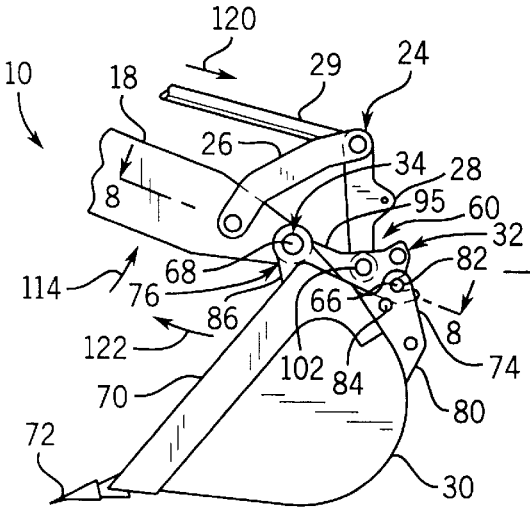
FIG. 5
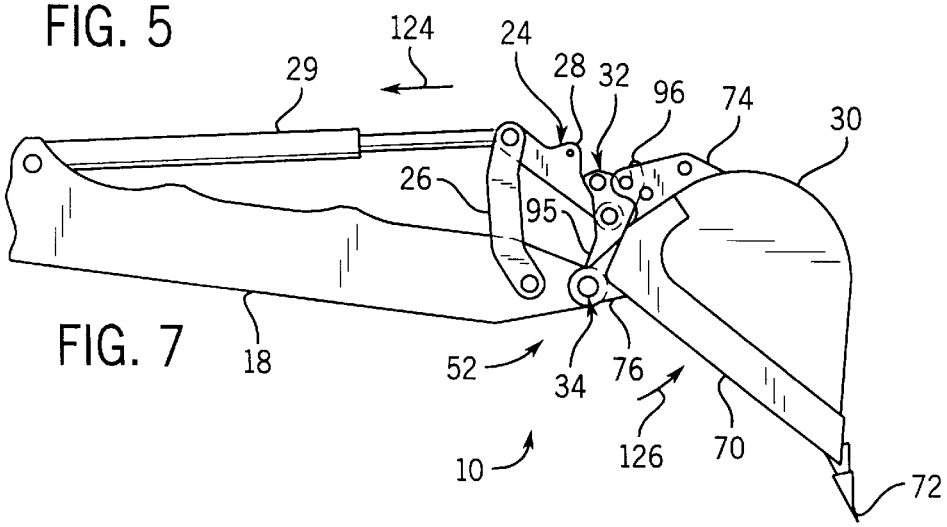
FIG. 7

EARTH-MOVING MACHINE BUCKET COUPLER

FIELD OF THE INVENTION

The present relates to earth-moving machines such as hydraulic excavators and backhoes. In particular, the present invention relates to a system for releasably coupling a bucket to a dipper stick.

BACKGROUND OF THE INVENTION

Earth-moving machines, such as hydraulic excavators and backhoes, are commonly used to move and excavate earth and other materials. Such machines typically include a chassis, a boom rotatably and pivotably coupled to the chassis, an arm or dipper stick pivotably coupled to the boom and a bucket pivotably coupled to the dipper stick. To pivot the bucket relative to the dipper stick, the dipper stick additionally supports a bucket pivot actuation linkage composed of a plurality of links coupled at one end to the dipper stick and coupled at another end to the bucket. The bucket pivot actuation links are pivoted relative to one another by a hydraulic cylinder assembly to thereby pivot the bucket about a main pivot axis. Pivotal movement of the bucket by the hydraulic cylinder assembly creates a digging or break out force. This digging force is generally defined as the force generated by the hydraulic cylinder assembly tangent to the arc or radius extending from the main pivot axis to the tip of the bucket's working edge or teeth. See S.A.E. Standard J1179, dated February 1990.

In many circumstances, it is necessary to replace an existing bucket on the earth-moving machine with a different bucket. Once the existing bucket has been removed, the new bucket must be mounted to the dipper stick. In conventional backhoes, this is achieved by aligning apertures formed in the bucket with apertures formed in an end of the dipper stick and by manually inserting a pin through these openings. Although seemingly simple, this procedure is tedious and time consuming for several reasons. First, the openings must be in precise alignment to enable the pin to be manually inserted with minimal force by the operator. However, perfectly aligning the apertures may require several attempts. Second, even assuming that the operator is able to perfectly align the apertures with a single attempt, the operator still must exit the operator station of the backhoe to manually insert the pin.

As a result of such difficulties, a multitude of bucket attachment devices have been developed which provide remote controlled extendable and retractable pins for coupling the bucket to the dipper stick and the bucket pivot actuation linkage. Despite eliminating the need for the operator to manually insert a pin to couple the bucket to the dipper stick, such attachment devices have several associated drawbacks. First, such attachment devices typically utilize a space consuming actuator to extend and retract the pins. In particular, one such known device utilizes a pair of hydraulic cylinders mounted about the pins to extend and retract the pins. Utilizing such a space consuming actuator is difficult due to the generally limited amount of space available at the junction of the bucket and the dipper stick.

Second, such prior bucket attachment devices typically offset the bucket pivot axes from the points at which the bucket is releasably connected to the dipper stick and the bucket pivot actuation linkage. For example, in one known bucket attachment device, the bucket pivots about first and second spaced-apart axes, yet is releasably connected to the dipper stick and the bucket pivot actuation linkage along third and fourth distinct axes. Due to this offset, the arc defined by the radius extending from the main bucket pivot axis to the tip of the working edge of the bucket is increased. As a result, the digging force generated by the bucket cylinders is reduced.

Thus, there is a continuing need for a hydraulic excavator and backhoe bucket attachment device or coupler which can be remotely controlled, which requires a minimum amount of space so as to be positioned in the limited space between the dipper stick and the bucket, and which does not reduce the digging force of the bucket by offsetting the bucket attachment points from the bucket pivot axes.

SUMMARY OF THE INVENTION

The present invention provides an improved earth-moving machine. The earth-moving machine includes a chassis, a boom pivotably coupled to the chassis and extending from the chassis, a dipper stick having a first dipper end pivotably coupled to the boom and a second opposite dipper end, a bucket pivot actuation linkage having a first linkage end coupled to the dipper stick and a second linkage end, a bucket having a first mounting portion and a second mounting portion, a first coupler releasably connecting the first mounting portion to the second linkage end and a second coupler releasably connecting the second mounting portion to the second dipper end. At least one of the first coupler and the second coupler includes a first pin extending at a junction of a bucket and a corresponding one of the second link end and the second dipper end, a first member forming a first opening configured to removably receive the first pin and at least one actuator coupled to one of the first member and the first pin. The bucket pivots about the first pin relative to said corresponding one of the second link end and the second dipper end. The first member and the first pin are movable relative to one another between an engaged position in which the opening receives the pin and a disengaged position. The at least one actuator moves the first pin and the first member between the engaged position and the disengaged position.

In one exemplary embodiment, said at least one of the first and second couplers includes a second pin extending at a junction of the bucket and the corresponding one of the second link end and the second dipper end and a second member forming a second opening configured to removable receive the second pin. In this embodiment, the bucket pivots about the second pin relative to said corresponding one of the second link end and the second dipper end. The second member and the second pin are movable relative to one another between an engaged position in which the second opening receives the second pin and a disengaged position. The at least one actuator is coupled to one of the second member and the second pin and moves the second pin and the second member between the engaged position and the disengaged position.

The present invention also provides an earth-moving machine which includes a chassis, a boom pivotably coupled to the chassis and extending from the chassis, a dipper stick pivotably coupled to the boom and extending from the boom, a bucket having first and second spaced mounting portions, the second mounting portion having first and second coaxial openings and a quick coupler selectively connecting and disconnecting the dipper stick and the implement. The quick coupler includes a first member releasably connected to the first mounting portion and a second member releasably connected to the second mounting portion. The second member includes first and second pins extending along an axis and movable between the first extended position in which the first and second pins project into the first and second openings, respectively, to couple the bucket to the dipper stick and a second retracted position in which the first and second pins are retracted from the first and second openings to at least partially uncouple the bucket from the dipper stick. The quick coupler further includes at least actuator coupled to the first and second pins to move the first and second pins between the first and second positions. The bucket pivots relative to the dipper stick about the axis of the first and second pins.

The present invention also provides an earth-moving machine which includes a chassis, a boom pivotably coupled to the chassis and extending from the chassis, a dipper stick pivotably coupled to the boom and extending from the boom, a bucket having at least one mounting portion, and a coupler releasably connecting the at least one mounting portion of the bucket to the dipper stick. The at least one coupler includes a first member, a second member, a first pin, a second coaxial pin and at least one actuator. The first and second members are coupled to a first one of the bucket and the dipper stick and provide first and second spaced coaxial openings. The first and second coaxial pins are coupled to a second one of the bucket and the dipper stick. The at least one of the first member and the second member and the first pin and the second pin are movable relative to one another between an engaged position in which the first and second openings receive the first pin and the second pin, respectively, and a disengaged position. The at least one actuator, at least a portion of which is coaxially disposed between the first and second pins, is configured to move at least one of the first pin and the second pin, and the first member and the second member, between the engaged position and the disengaged position.

BRIEF DESCRIPTION OF THE DRAWINGS

FIG. 2 is a fragmentary side elevational view of the dipper stick of FIG. 1 separated from the bucket.

FIG. 4 is a fragmentary side elevational view of the dipper stick of FIG. 2 with the first coupler engaging the bucket.

FIG. 5 is a fragmentary side elevational view of the dipper stick and bucket of FIG. 3 with the first and second couplers connecting the dipper stick and the bucket.

FIG. 7 is a fragmentary side elevational view of the bucket of FIG. 5 illustrating pivoting of the bucket.

DETAILED DESCRIPTION OF THE PREFERRED EMBODIMENTS

Figure 1:
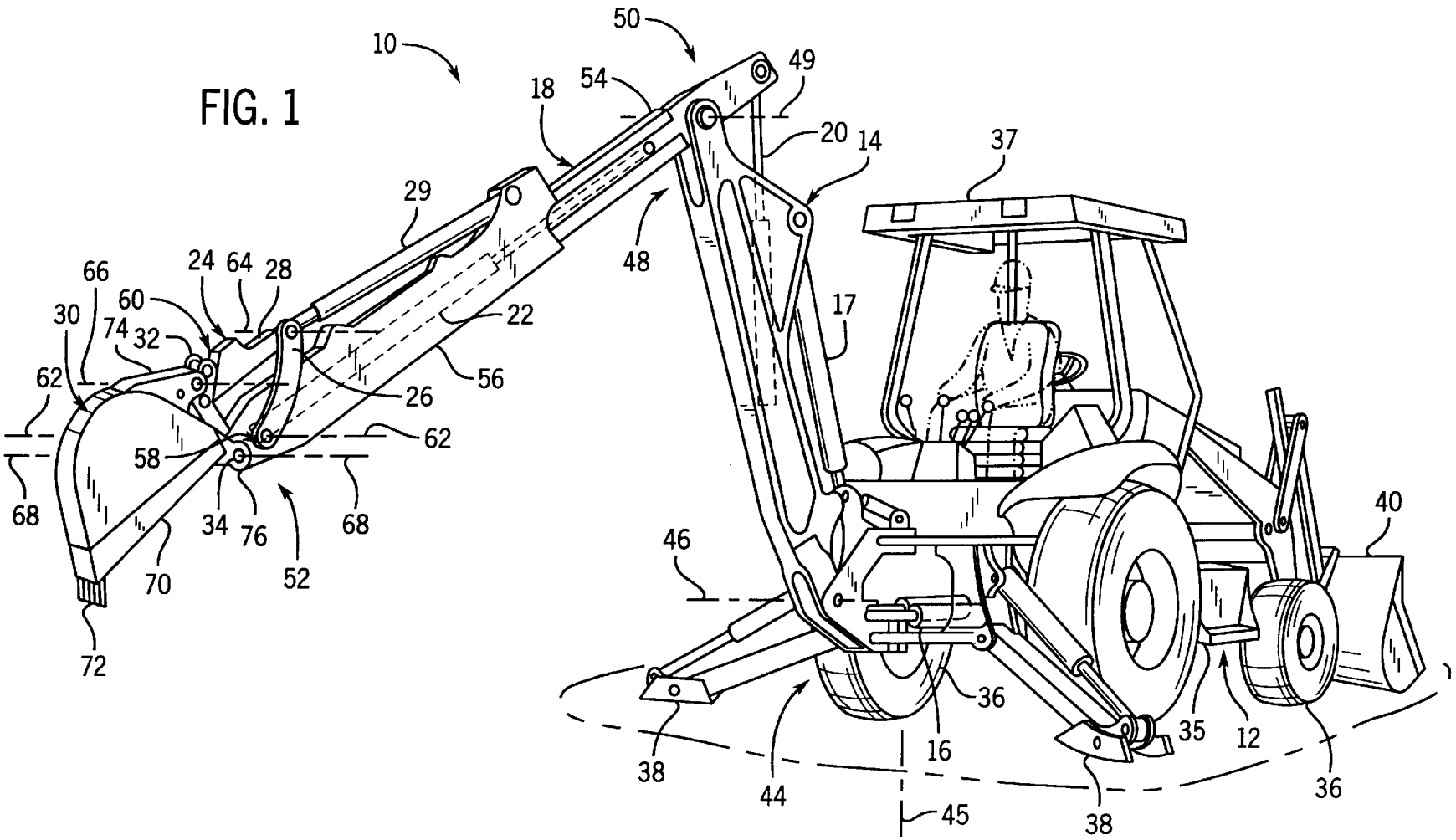
FIG. 1 is a perspective view of an earth-moving machine having a bucket coupled to a dipper stick and a bucket pivot actuation linkage by a first coupler and a second coupler.

FIG. 1 is a perspective view of an earth-moving machine 10, known as a backhoe. Machine 10 generally includes chassis 12, boom 14, boom actuators 16, 17, dipper stick 18, actuator 20, actuator 22, bucket pivot actuation linkage 24 including links 26, 28, actuator 29, bucket 30, and couplers 32, 34. Chassis 12 is conventionally known and comprises a general frame 35 and wheels 36 for movably supporting earth-moving machine 10. Frame 35 supports the body or engine, transmission and hydraulic system (not shown) of machine 10. Frame 35 further provides an operator station 37 including various controls for operation of machine 10. As shown in FIG. 1, chassis 12 additionally includes outrigger members 38 for stabilizing machine 10 during use. Alternatively, machine 10 may omit outrigger members 38. Furthermore, although machine 10 is illustrated as comprising a tractor having wheels 36 and as including a front-mounted bucket 40, machine 10 may have various other configurations. For example, machine 10 may be crawler mounted and may omit bucket 40 in lieu of other front mounted structures. Boom 14, dipper stick 18, linkage 24 and bucket 30 may also be front mounted.

Boom 14 is pivotably coupled to frame 35 of chassis 12 and extends from frame 35. In particular, boom 14 has a first end 44 pivotably coupled to frame 35 for rotation about a generally vertical axis 45 and a generally horizontal axis 46 for positioning dipper stick 18. Boom 14 has a second end 48 pivotably coupled to dipper stick 18 to enable dipper stick 18 to be further pivoted about a horizontal axis 49.

Actuator 16 is coupled between chassis 12 and boom 14. Actuator 16 pivots boom 14 about axis 45. Actuator 17 is coupled between chassis 12 and boom 14 to pivot boom 14 about axis 46 in a conventionally known manner. As a result, dipper stick 18 and bucket 30 may be positioned at variety of locations to move earth. Actuators 16 and 17 preferably comprise hydraulic cylinder assemblies coupled to the hydraulic system of machine 10 and controlled in a conventionally known manner from operator station 37.

Dipper stick 18 comprises an elongate arm having a first end 50 pivotably coupled to boom 14 and a second opposite dipper end 52. Actuator 20 comprises a hydraulic cylinder assembly coupled between boom 14 and dipper stick 18. Actuator 20 is hydraulically driven by the hydraulic system of machine 10 in a conventionally known manner. Upon being extended and retracted, actuator 20 pivots dipper stick 18 about axis 49 to reposition dipper stick 18 and bucket 30 in a conventionally known manner.

In the exemplary embodiment, dipper stick 18 includes an outer arm 54 and an inner arm 56 telescopically received within outer arm 54. Actuator 22 is coupled between outer arm 54 and inner arm 56 to selectively slide arms 54 and 56 relative to one another to selectively extend and retract the length of dipper stick 18. As will be appreciated, dipper stick 18 may alternatively comprise a single elongate member omitting actuator 22 where the selected extension and retraction of dipper stick 18 is not necessary or desired.

Bucket pivot actuation linkage 24 has a first linkage end 58 coupled to dipper stick 18 and a second linkage end 60 coupled to coupler 32. In particular, link 26 and link 28 are pivotably coupled to one another to form linkage 24 and are further coupled to actuator 29.

Actuator 29 is pivotably coupled between arm 56 of dipper stick 18 and linkage 24. Actuator 29 preferably comprises a conventionally known hydraulic cylinder assembly fluidly coupled to the hydraulic fluid system of machine 10 in a conventionally known manner. Upon being selectively extended and retracted, actuator 29 pivots link 26 about axis 62 to correspondingly pivot link 28 about axis 64 and bucket 30 about axes 66 and 68.

Bucket 30 comprises a bucket having a main body 70, a working edge 72 and mounting portions 74, 76. Body 70 is generally a concave configuration and is sized to receive earth and other material being removed by machine 10. Working edge 72 comprises a generally toothed forward edge extending laterally, generally transverse to the forward of the plane of bucket 30. Mounting portions 74 and 76 extend at a rear edge of body 70 opposite working edge 72. Mounting portions 74 and 76 cooperate with couplers 32 and 34, respectively, to releasably couple bucket 30 to dipper stick 18 and bucket pivot actuation linkage 24.

FIGS. 2–6 illustrate mounting portions 74, 76 of bucket 30, end 52 of dipper stick 18 and couplers 32 and 34 in greater detail. As best shown by FIGS. 4 and 5, mounting portion 74 includes a pair of opposing spaced devises 80 supporting pins 82 and 84 therebetween. Mounting portion 76 comprises a pair of opposing spaced ears 86 providing opposing coaxial openings 88. Ears 86 extend proximate to an upper portion 90 of bucket 30 while devises 80 and pins 82, 84 extend along a back side 92 of bucket 30.

Couplers 32 and 34 selectively connect and disconnect end 52 of dipper stick 18 and end 60 of linkage 24 to mounting portions 74 and 76 of bucket 30, respectively. In the exemplary embodiment, coupler 32 comprises an extension 95 having a hook 96. Extension 95 is pivotably coupled to end 52 for rotation about axis 68 and pivotably coupled to end 60 of linkage 24 about axis 62. As shown in FIGS. 4 and 5, extension 95 preferably includes a pin 102 about which end 60 pivots. Hook 96 is configured to engage pin 82 between devises 80 to thereby couple linkage end 60 to mounting portion 74. Hook 96 is pivoted about axis 68 by extension and retraction of actuator 29.

Coupler 34 includes a pair of coaxial pins 100 and an actuator 106 at end 52 of dipper stick 18. Pins 100 are movable between an engaged position in which pins 100 extend at least partially through openings 88 of ears 86 and a disengaged position in which pins 100 are substantially withdrawn from openings 88. Actuator 106 moves pins 100 between the engaged position and the disengaged position. In the engaged positions, pins 100 couple end 52 of dipper stick 18 to mounting portion 76 of bucket 30. When hook 96 is engaged with pin 82 and when openings 88 are receiving pins 100, bucket 30 is coupled to dipper stick 18 and bucket pivot actuation linkage 24.

Figure 3:
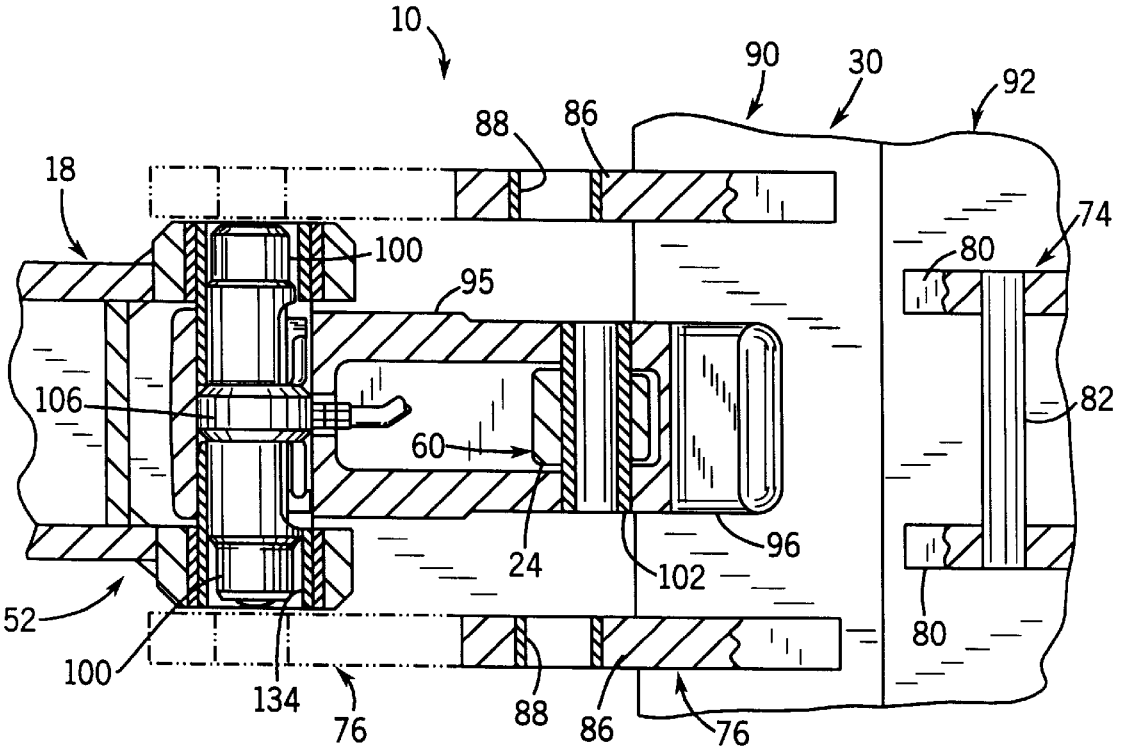
FIG. 3 is a sectional view of the dipper stick and bucket of FIG. 2 taken along lines 3—3.
Figure 6:
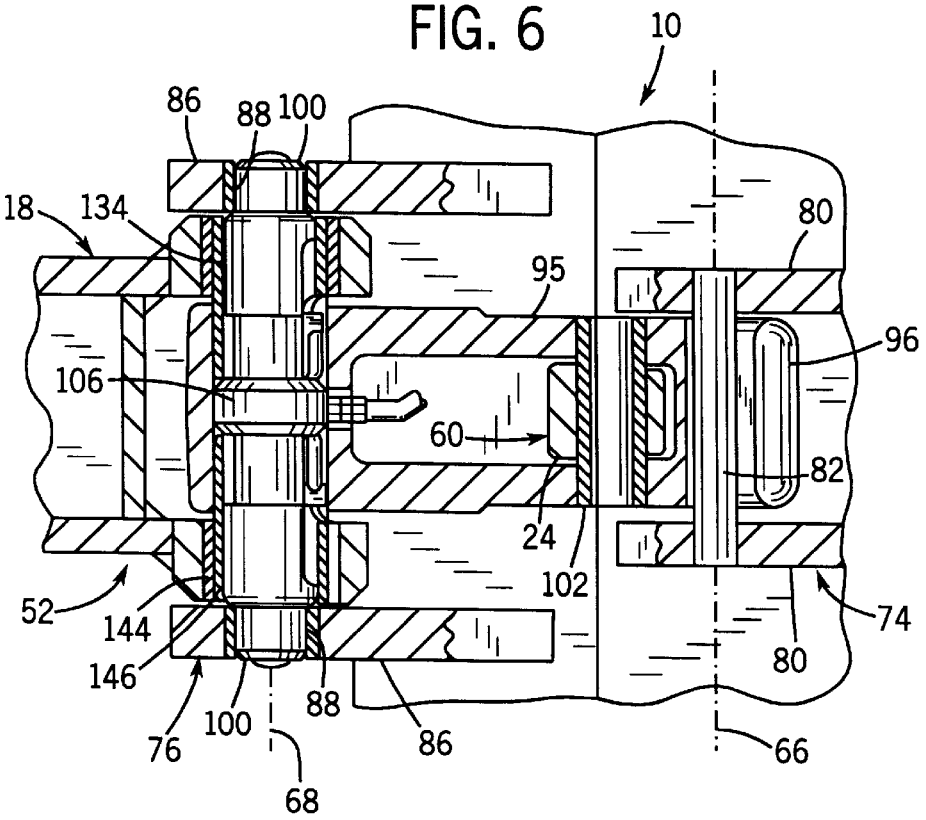
FIG. 6 is a sectional view of the bucket of FIG. 5 taken along lines 6—6.

FIGS. 2–6 illustrate couplers 32 and 34 coupling bucket 30 to dipper stick 18 and bucket pivot actuation linkage 24. As shown by FIG. 2, at least one of actuators 16, 17, 20 and 22 (shown in FIG. 1) are extended or retracted as necessary to align hook 96 with pin 82 between devises 80 and to move hook 96 in the direction indicated by arrow 110 until hook 96 receives pin 82. As shown in FIG. 3, once hook 96 has received pin 82, at least one of actuators 17, 20 and 29 are actuated to move end 52 of dipper stick 18 in the direction indicated by arrow 112 until pins 100 are coaxially aligned with openings 88. Once pins 100 are positioned in alignment with openings 88, actuator 106 moves pins 100 to the engaged position in which pins 100 extend through openings 88 as shown in FIG. 6. Once pins 100 are moved into the engaged position in which pins 100 at least partially extend through openings 88, bucket 30 is coupled to dipper stick 18 and bucket pivot actuation linkage 24. As shown in FIG. 5, once coupled to dipper stick 18 and bucket pivot actuation linkage 24, bucket 30 may be lifted off of the supporting surface by movement of dipper stick 18 in the direction indicated by arrow 114. The actuation of actuator 29 in the direction indicated by arrow 120 pivots bucket 30 about axis 66 provided by pin 82 and about axis 68 provided by pins 100 to pivot bucket 30 in the direction indicated by arrow 122. As shown in FIG. 7, actuation of actuator 29 in the direction indicated by arrow 124 pivots bucket 30 about axes 66 and 68 to pivot bucket 30 in the direction indicated by arrow 126.

Overall, coupler 34 advantageously provides two simultaneous functions. First, coupler 34 enables bucket 30 to be releasably coupled to end 52 of dipper stick 18 by mere actuation of actuator 106. Coupler 34 enables the connection of bucket 30 to dipper stick 18 utilizing hydraulic power from the hydraulic system of machine 10. This can be done by the operator without requiring the operator to even leave operator station 37. Second, coupler 34 simultaneously provides a pivot axis for bucket 30 relative to dipper stick 18. In particular, pins 100 of coupler 34 not only couple bucket to dipper stick 18, but pins 100 also function as a hinge about which bucket 30 pivots during use. Because pins 100 simultaneously serve both functions, the connection between bucket 30 and dipper stick 18 and the pivot axis 68 of bucket 30 are not offset, but are coaxial. As a result, the maximum bucket tangential force, also known as a breakout force, defined as a digging force generated by the bucket cylinders and tangent to the arc or radius from pivot axis 68 and the tip working edge 72 (SAE Standard J1179, dated February 1990) is increased as compared to those earth-moving machines in which the pivot axis between the bucket 30 and the dipper stick 18 and the connection point between the bucket 30 and dipper stick 18 are offset from one another.

Although couplers 32 and 34 are illustrated as comprising hook 96 and a pair of coaxial pins 100, wherein hook 96 engages mounting portion 74 and wherein pins 100 are moved to engage mounting portion 76, various alternative configurations for couplers 32 and 34 are also contemplated. For example, the relationship of hook 96 and pins 100 as well as mounting portions 74 and 76 to dipper stick 18 and bucket pivot actuation link 24 could be reversed. In such an alternative configuration, end 52 of dipper stick 18 includes hook, mounting portion 76 includes a clevis supported pin configured to be engaged by the hook, extension 95 includes pins 100 and actuator 106, and mounting portion 74 includes ears providing a pair of coaxial openings configured to receive pins 100. Furthermore, in lieu of utilizing an actuator 106 to move pins 100 into and out of engagement with openings 88 of ears 86, coupler 34 may alternatively utilize movable ears and fixed pins, wherein the ears and their coaxial openings are moved by an actuator into and out of engagement with the pins. Although presently viewed as less desirable, such alternative configurations would retain many of the same advantageous features set forth above.

Figure 8:
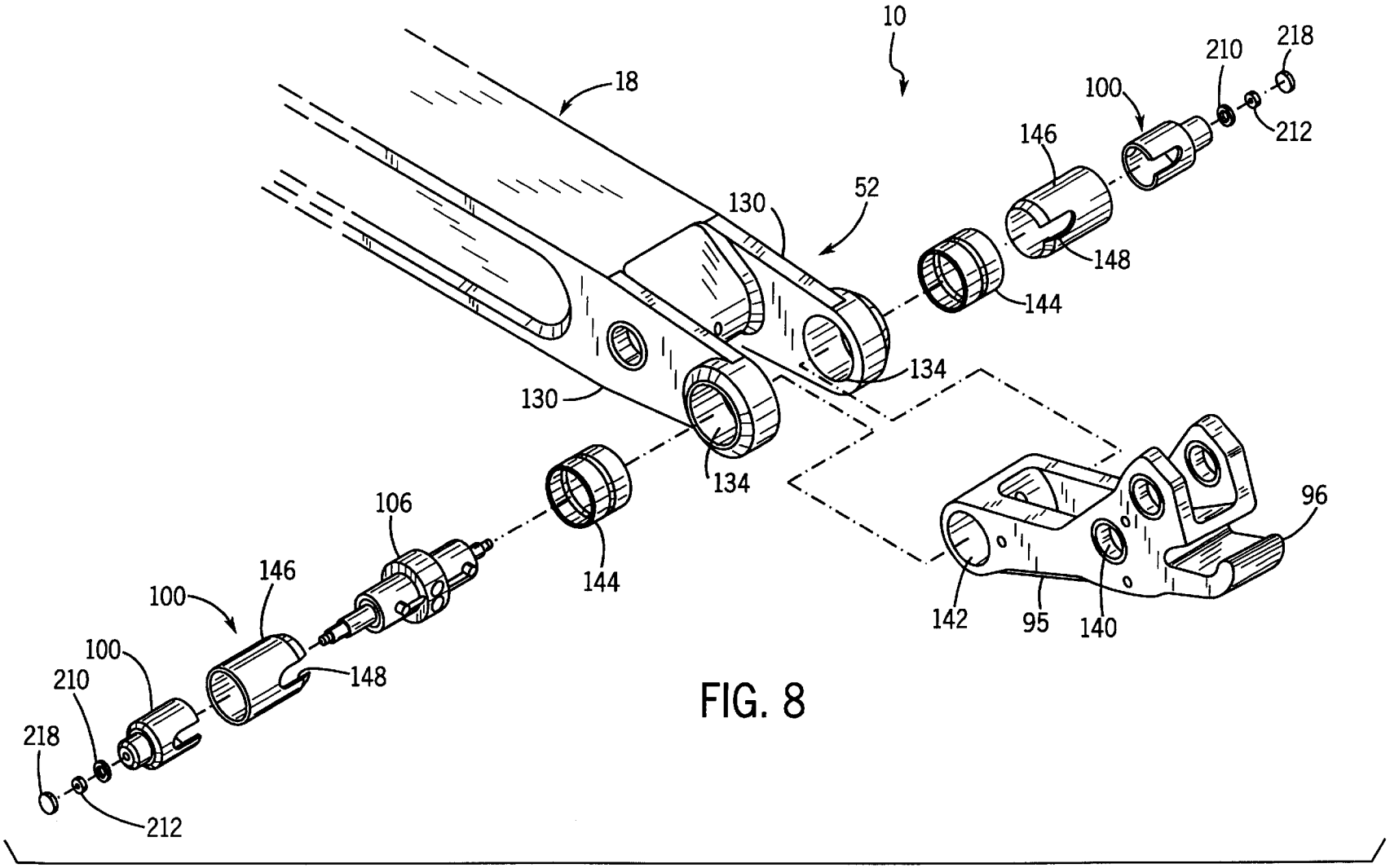
FIG. 8 is an exploded perspective view of an end of the dipper stick of FIG. 2, the first coupler and the second coupler.

FIGS. 8–11 illustrate couplers 32 and 34 in greater detail. FIG. 8 is an exploded perspective view of end 52 of dipper stick 18, coupler 32 and coupler 34 including pins 100 and actuator 106. As best shown by FIG. 8, end 52 of dipper stick 18 includes two spaced ears 130 defining a pair of coaxial openings 134. Openings 134 are sized to receive pins 100 and actuator 106. As further shown by FIG. 8, end 52 includes bushings 144 and sleeve 146. Bushings 144 mount within openings 134. Sleeves 146 mount within bushings 144 and receive pins 100 and actuator 106 to guide the extension and retraction of pins 100. Each of sleeves 146 includes an elongate cutout or slot 148 to provide clearance for actuator 106.

As best shown by FIG. 8, extension 95 includes a bore 140 for enabling hook 96 to be pivotably pinned to link 28 by pin 102. In addition to being coupled to end 60 of bucket pivot actuation linkage 24, extension 95 is also pivotably coupled to end 52 of dipper stick 18. Accordingly, extension 95 further includes bore 142 positioned in coaxial alignment with openings 134 and sized to receive actuator 106 and pins 100. As a result, hook 96 pivots about axis 68 upon extension and retraction of actuator 29.

Figure 9:
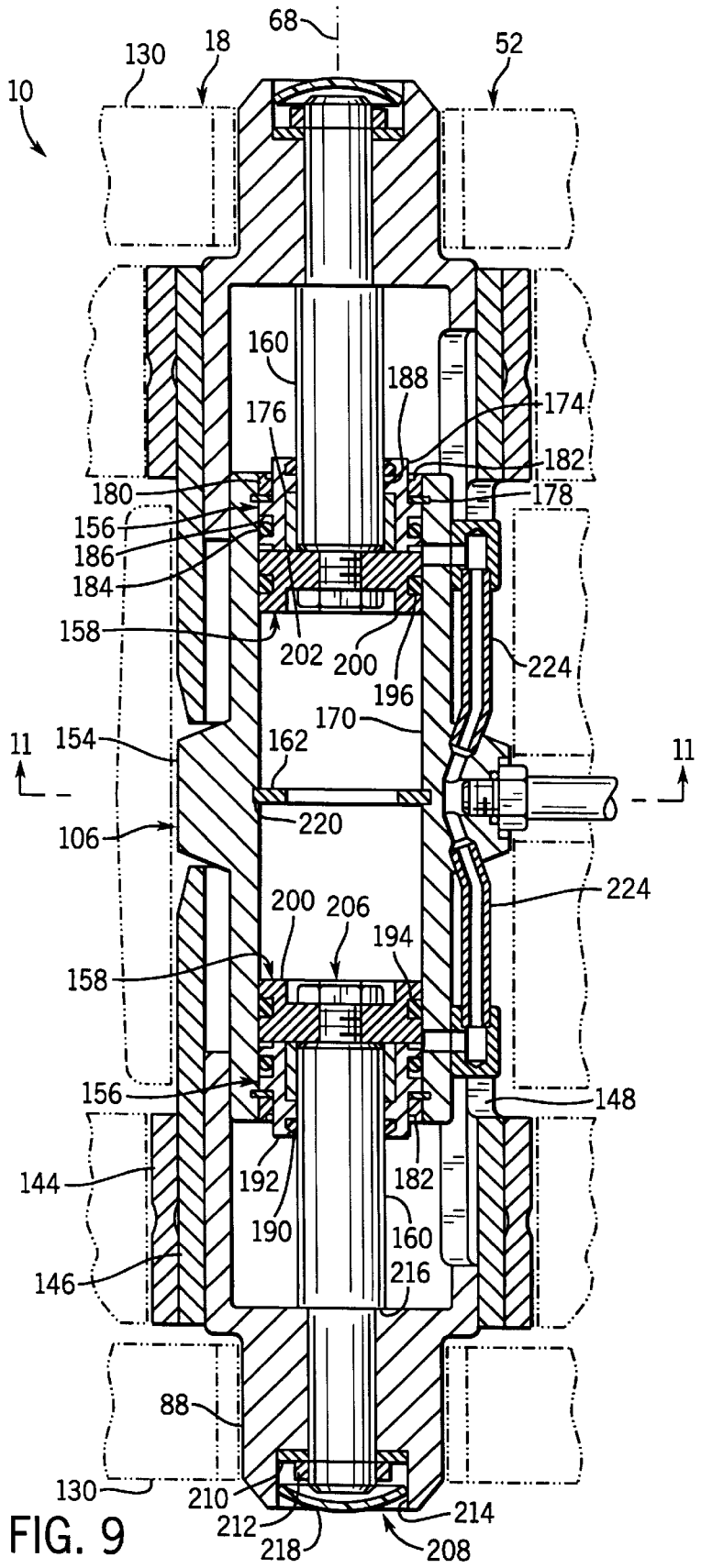
FIG. 9 is a sectional view of the second coupler of FIG. 5.

Actuator 106 mounts between ears 130 of end 52 within sleeves 146. As best shown by FIG. 9, actuator 106 generally includes tube 154, gland assemblies 156, pistons 158, rods 160 and fluid supply conduits 164, 166. Tube 154 comprises a generally elongate cylinder having a bore 170 extending therethrough. Tube 154 is positioned within sleeves 146 and within bore 142 of extension 95 and openings 134 of end 52. Tube 154 acts as a pressurized cylinder by receiving hydraulic fluid through conduits 164 and 166 to move pistons 158 and to thereby extend and retract rods 160 and pins 100.

Gland assemblies 156 extend at opposite ends of bore 170 to seal off ends of bore 170 about rods 160. Each gland assembly 156 includes gland 174 and bushing 176. Gland 174 fits within bore 170 and is held in place by snap ring 178, spacer 180 and snap ring 182. Snap ring 178 fits within a groove formed within the inner surface of tube 154 and retains spacer 180. Spacer 180 extends between snap rings 178 and 182. Snap ring 182 fits within an outer circumferential groove formed within gland 174 and acts against spacer 180 to retain gland 174. Gland 174 is sealed against the inner circumferential surface of bore 170 by seal 184. In the exemplary embodiment, seal 184 comprises an 0ring captured within an outer circumferential groove 186 in gland 174. Gland 174 further includes an axial opening 188 through which rod 160 extends. Gland 174 includes a seal 190 along its inner circumferential surface to seal between gland 174 and rod 160. Seal 190 preferably comprises an O-ring captured within a groove 192 of gland 174. As will be appreciated, various other seals may be utilized in lieu of the exemplary seals 184 and 190.

Bushing 176 comprises a conventional bushing press fit within gland 174 about rod 160. Bushing 176 serves as a bearing.

Pistons 158 are movably disposed within bore 170 between gland assemblies 156 and are coupled to rods 160. Each piston 158 is sealed against an inner circumferential surface of bore 170 by seal 194. Seal 194 preferably comprises an O-ring captured within an outer circumferential groove 196 in piston 158. Each piston 158 includes an inner face 200 and outer face 202 against which fluid pressure is applied. Pistons 158 move within bore 170 in response to fluid pressure applied to faces 200 and 202 to thereby extend and retract rods 160.

Rods 160 extend through gland assemblies 156 at opposite ends of tube 154. Each rod 160 has an inner end 206 coupled to piston 158 and an outer end 208 coupled to one of pins 100. In the exemplary embodiment, end 206 of rod 160 extends through piston 158 and is bolted to piston 158 in a sealed fashion. End 208 extends through pin 100 and is secured to pin 100 by washer 210 and nut 212. Washer 210 extends about end 208 of rod 260 within end cavity 214 of pin 100. Nut 212 threads onto an end of rod 160 at end 208 to couple pin 100 to rod 160 by capturing pins 100 between washer 210, nut 212 and shoulder 216 of rod 160. Once washer 210 and nut 212 have been assembled to end 208 of rod 160, cavities 214 of pins 100 are capped off by expansion plug 218.

Retaining ring 162 generally comprises an annular snap ring mounted within bore 170 of tube 154 at a midpoint between gland assemblies 156. Retaining ring 162 fits within an inner circumferential groove 220 from within tube 154. Retaining ring 162 spaces apart pistons 158 and engages pistons 158 to limit inward travel of pistons 158 when hydraulic pressure is applied to faces 202.

Figure 11:
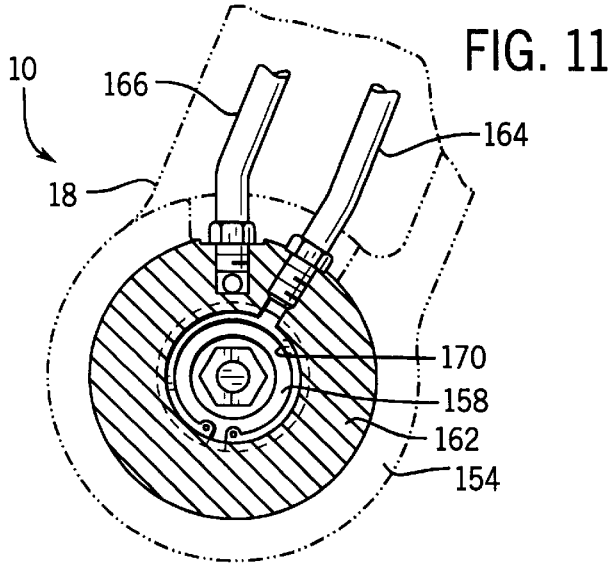
FIG. 11 is a sectional view of the second coupler of FIG. 9 taken along lines 11—11.

Fluid conduits 164 and 166 communicate with bore 170 on opposite sides of faces 200 and 202 of pistons 158, respectively. As best shown by FIG. 11, fluid conduit 164 extends through tube 154 and communicates with bore 170 at a midpoint between gland assemblies 156 to communicate with faces 200 of pistons 158. As shown by FIG. 9, fluid conduit 166 extends through tube 154 into bore 170 to communicate with faces 202 of pistons 158. Fluid conduits 164 and 166 are each fluidly connected to a conventionally known hydraulic supply system of machine 10 and are selectively connected to a source of pressurized hydraulic fluid and a hydraulic sump or reservoir in a conventionally known manner, such as with valves, to control the flow of hydraulic fluid to bore 170 on either side of faces of 200 or 202 of pistons 158.

By selectively supplying hydraulic fluid to either faces 200 or 202 of pistons 158, machine 10 extends or retracts rods 160 and pins 100 to selectively couple and uncouple end 52 of dipper stick 18 to mounting portion 76 of bucket 30. For example, once pins 100 have been moved into alignment with openings 88 of bucket 30 as shown in FIG. 3, the hydraulic supply system of machine 10, in response to appropriate control signals, supplies hydraulic fluid through fluid conduits 164 and into bore 170. The pressurized hydraulic fluid exerts a force upon faces 200 of pistons 158 to move pistons 158 away from one another and to thereby extend rods 160 and pins 100 outward into openings 88. As a result, mounting portion 76 of bucket 30 is coupled to end 52 of dipper stick 18. During this cycle, hydraulic fluid within bore 170 adjacent to faces 202 of pistons 158 is expelled through fluid conduit 166 to hydraulic reservoir or other sump.

Figure 10:
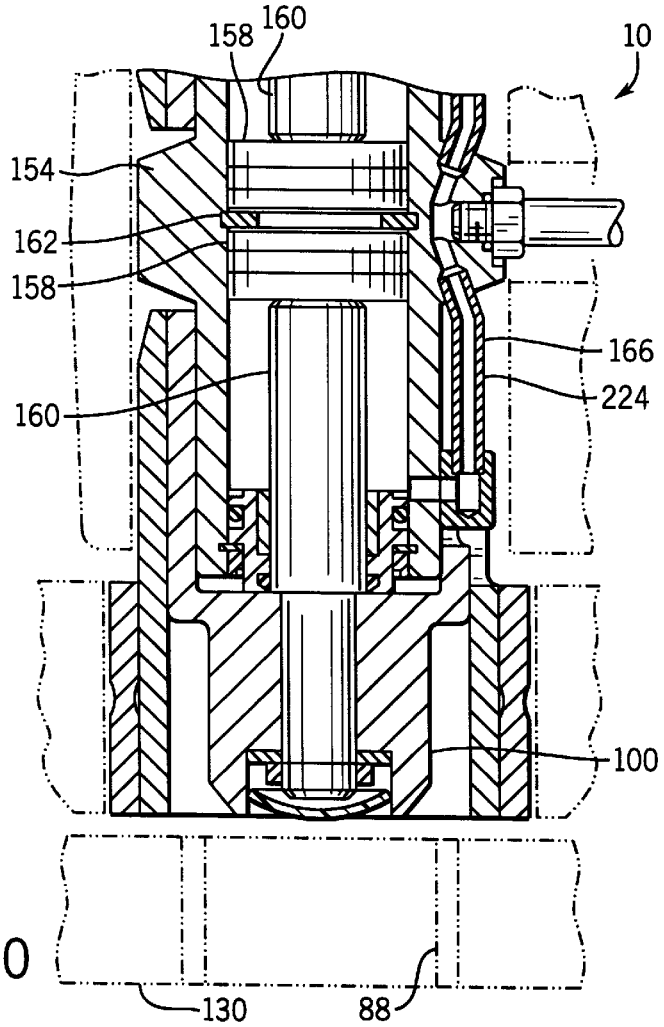
FIG. 10 is a fragmentary sectional view of the second coupler in the position shown in FIG. 2.

As shown by FIG. 10, to uncouple bucket 30 from end 52 of dipper stick 18, the hydraulic control system of machine 10, in response to appropriate control signals, supplies hydraulic fluid through fluid conduit 166 to bores 170 adjacent to faces 202 of pistons 158. The pressurized hydraulic fluid acts upon faces 202 to move pistons 158 towards one another until pistons 158 engage glands 174. Hydraulic fluid proximate faces 202 is expelled through fluid conduit 164 to the hydraulic reservoir or other sump. Movement of pistons 158 towards one another retracts and withdraws rods 160 and pins 100 from openings 88 such that mounting portion 76 of bucket 30 may be uncoupled from end 52 of dipper stick 18.

In the exemplary embodiment, fluid conduits 164 and 166 are each illustrated as including tubing 224 extending along an exterior of tube 154 within slots 148 of sleeves 146. Alternatively, fluid conduits 164 and 166 may omit such tubing 224 by instead forming the same fluid passages integrally within exterior walls of tube 154 by casting or drilling or by otherwise forming such passages as part of tube 154. Such an alternative configuration eliminates several seals and connections associated with tubing 224.

Because actuator 106 is coaxially disposed between pins 100, actuator 106 utilizes existing space between pins 100. This is extremely important in earth-moving machines, such as backhoes and excavators, where valuable space between the bucket and the dipper stick is limited. As a result, actuator facilitates the mounting of bucket 30 to end 52 of dipper stick 18 and to end 60 of pivot bucket actuation linkage 24 about the same axes 68 and 66 about which bucket 30 also pivots. Consequently, actuator 106 eliminates or at least reduces any offset between the attachment points of the bucket and the pivot axes of the bucket, which would otherwise reduce digging or break out force.

Because actuator 106 utilizes a single tube 154 which serves as a hydraulic cylinder containing two piston and rod assemblies separated only by retaining ring 162, actuator 106 requires fewer parts and, more importantly, requires less space. This configuration of actuator 106 further facilitates the positioning of actuator 106 coaxially between pins 100. Although less desirable, actuator 106 may alternatively utilize two substantially distinct and independent hydraulic cylinder and piston assemblies coaxially disposed between pins 100. Furthermore, actuator 106 may alternatively comprise one or more hydraulic cylinder piston assemblies disposed parallel to and aside pins 100. Although actuator 106 is disclosed as comprising a hydraulically driven linear actuator, actuator 106 may alternatively comprise one or more pneumatically, electrically or mechanically driven linear actuators such as solenoids, jackscrews and the like.

Although the present invention has been described with reference to preferred embodiments, workers skilled in the art will recognize that changes may be made in form and detail without departing from the spirit and scope of the invention. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. An earth-moving machine comprising:

a chassis;

a boom pivotably coupled to the chassis and extending from the chassis;

a dipper stick having a first dipper end pivotably coupled to the boom and a second opposite dipper end;

a bucket pivot actuation linkage having a first linkage end coupled to the dipper stick and a second linkage end;

a bucket having a first mounting portion including a bucket pin and a second mounting portion;

a first coupler pivotably coupled to the second dipper end for pivotal movement about a first axis and pivotably coupled to the second linkage end, the first coupler including a hook releasably engaging the bucket pin;

a second coupler releasably connecting the second mounting portion to the second dipper end, wherein the second coupler includes:

a first coupling pin extending along the first axis at a junction of the bucket and the second dipper end, wherein the bucket pivots about the first coupling pin relative to the second dipper end;

a first member coupled to the second mounting portion of the bucket and forming a first opening configured to removably receive the first coupling pin, wherein the first member and the first coupling pin are movable relative to one another between an engaged position in which the first opening receives the first coupling pin and a disengaged position; and at least one actuator coupled to one of the first member and the first coupling pin, wherein the at least one actuator moves the first coupling pin and the first member between the engaged position and the disengaged position.

2. The earth-moving machine of claim 1 wherein the at least one actuator moves the first coupling pin between the engaged position and the disengaged position.

3. The earth-moving machine of claim 1 wherein the second coupler includes a second coupling pin extending at a junction of the bucket and the second dipper end, wherein the bucket pivots about the second coupling pin relative to the second dipper end; and a second member forming a second opening configured to removably receive the second coupling pin, wherein the second member and the second coupling pin are movable relative to one another between an engaged position in which the second opening receives the second coupling pin and a disengaged position and wherein the at least one actuator is coupled to one of the second member and the second coupling pin and moves the second coupling pin and the second member between the engaged position and the disengaged position.

4. The earth-moving machine of claim 3 wherein the at least one actuator moves the first and second coupling pins between the engaged position and the disengaged position.

5. The earth-moving machine of claim 4 wherein the at least one actuator moves the first and second coupling pins away from one another into the engaged position and towards one another into the disengaged position.

6. The earth-moving machine of claim 4 wherein the at least one actuator includes:

a cylinder;

first and second pistons disposed within the cylinder, each piston having a first side and a second side, wherein the first and second pistons are coaxially coupled to the first and second coupling pins; and at least one source of hydraulic pressure fluidly coupled to at least one of the first and second sides of each of the first and second pistons.

7. The earth-moving machine of claim 6 including first and second rods coupled to the first and second pistons and coupled to the first and second coupling pins, respectively.

8. The earth-moving machine of claim 6 wherein the at least one source of hydraulic pressure is fluidly coupled to both the first and second sides of the first and second pistons.

9. The earth-moving machine of claim 6 including a retainer disposed within the cylinder between the first and second pistons.

10. The earth-moving machine of claim 6 wherein each of the first and second coupling pins includes an opening through which a fluid conduit extends and fluidly couples the at least one source of hydraulic pressure and said at least one of the first and second sides of each of the first and second pistons.

11. The earth-moving machine of claim 3 wherein the at least one actuator includes:

at least one cylinder extending coaxially between the first and second coupling pins;

first and second pistons disposed within the at least one cylinder, each piston having a first side and a second side, wherein the first and second pistons are coaxially coupled to the first and second coupling pins; and at least one source of hydraulic pressure fluidly coupled to at least one of the first and second sides of each of the first and second pistons, and wherein the second coupler further includes:

at least one sleeve receiving the first and second coupling pins and the cylinder, wherein the first and second coupling pins and the cylinder move with the at least one sleeve; and at least one bushing receiving the at least one sleeve and disposed within the dipper stick.

12. The earth-moving machine of claim 1 wherein the opening of the first member is continuously bounded.

13. The earth-moving machine of claim 1 wherein the at least one actuator includes a hydraulic actuator.

14. An earth-moving machine comprising:

a chassis;

a boom pivotably coupled to the chassis and extending from the chassis;

a dipper stick pivotably coupled to the boom and extending from the boom;

a bucket having first and second spaced mounting portions, the second mounting portion having first and second coaxial openings;

a quick coupler selectively connecting and disconnecting the dipper stick and the implement, the quick coupler including:

a first member releasably connected to the first mounting portion; and a second member releasably connected to the second mounting portion, wherein the second member includes:

first and second pins extending along an axis and movable between a first extended position in which the first and second pins project into the first and second openings, respectively, to couple the bucket to the dipper stick and a second retracted position in which the first and second pins are retracted from the first and second openings to at least partially uncouple the bucket from the dipper stick;

at least one actuator coupled to the first and second pins to move the first and second pins between the first and second positions, wherein the bucket pivots relative to the dipper stick about the axis of the first and second pins, wherein the at least one actuator includes:

a cylinder;

first and second pistons disposed within the cylinder, each piston having a first side and a second side, wherein the first and second pistons are coaxially coupled to the first and second coupling pins; and at least one source of hydraulic pressure fluidly coupled to at least one of the first and second sides of each of the first and second pistons;

at least one sleeve receiving the first and second pins and the cylinder, wherein the first and second pins and the cylinder move with the at least one sleeve; and at least one bushing receiving the at least one sleeve and coupled to the dipper stick.

15. The earth-moving machine of claim 14 wherein the at least one actuator moves the first and second pins away from one another into the engaging position and towards one another into the disengaged position.

16. The earth-moving machine of claim 14 including first and second rods coupled to the first and second pistons and coupled to the first and second pins, respectively.

17. The earth-moving machine of claim 14 wherein the at least one source of hydraulic pressure is fluidly coupled to both the first and second sides of the first and second pistons.

18. The earth-moving machine of claim 14 wherein each of the first and second pins includes an opening through which a fluid conduit extends and fluidly couples the at least one source of hydraulic pressure and said at least one of the first and second sides of each of the first and second pistons.

19. An earth-moving machine comprising:

a chassis;

a boom pivotably coupled to the chassis and extending from the chassis;

a dipper stick pivotably coupled to the boom and extending from the boom;

a bucket having at least one mounting portion;

a coupler releasably connecting the at least one mounting portion of the bucket to the dipper stick, the at least one coupler including:

a first member and a second member coupled to a first one of the bucket and the dipper stick, wherein the first member and the second member provide first and second spaced coaxial openings;

a first pin and a second pin disposed along an axis coupled to a second one of the bucket and the dipper stick, wherein said at least one of the first member and the second member, and the first pin and the second pin are movable relative to one another between an engaged position in which the first and second openings receive the first pin and the second pin, respectively, and a disengaged position; and at least one actuator, at least a portion of which is disposed along the axis between the first and second pins, the actuator being configured to move at least one of the first pin and the second pin, and the first member and the second member, between the engaged position and the disengaged position, wherein the at least one actuator includes:

at least one cylinder extending coaxially between the first and second pins;

first and second pistons disposed within the at least one cylinder, each piston having a first side and a second side, wherein the first and second pistons are coaxially coupled to the first and second pins; and at least one source of hydraulic pressure fluidly coupled to at least one of the first and second sides of each of the first and second pistons;

at least one sleeve receiving the first and second pins and the cylinder, wherein the first and second pins and the cylinder move with the at least one sleeve; and at least one bushing receiving the at least one sleeve and disposed within the dipper stick.

* * * * *